US005208403A

United States Patent [19]

Buchanan et al.

[11] Patent Number: 5,208,403

[45] Date of Patent: May 4, 1993

[54] HIGH VI LUBRICANT BLENDS FROM SLACK WAX

[75] Inventors: J. Scott Buchanan, Mercerville; Margaret M. Wu, Skillman, both of N.J.

[73] Assignee: Mobil Oil Corporation, Fairfax, Va.

[21] Appl. No.: 876,801

[22] Filed: Apr. 28, 1992

Related U.S. Application Data

[63] Continuation of Ser. No. 818,582, Jan. 9, 1992, abandoned.

[51] Int. Cl.[5] ..... C10L 1/16; C07C 2/02

[52] U.S. Cl. ..... 585/7; 585/1; 585/10; 585/16; 585/302; 585/304; 585/520; 585/530; 585/532; 585/661; 585/671

[58] Field of Search ..... 585/1, 7, 10, 16, 302, 585/304, 520, 530, 532, 661, 671

[56] References Cited

U.S. PATENT DOCUMENTS

| | | | |
|---|---|---|---|
| 2,642,466 | 6/1953 | Garner et al. | 260/683 |
| 3,103,485 | 9/1963 | Cahn | 208/130 |
| 3,705,926 | 12/1972 | Rumpf et al. | 260/683 |
| 4,042,488 | 8/1977 | Perciful | 208/102 |
| 4,327,237 | 4/1982 | Imparato et al. | 585/10 |
| 4,420,646 | 12/1983 | Darden et al. | 585/10 |
| 4,827,064 | 5/1989 | Wu | 585/10 |
| 4,827,073 | 5/1989 | Wu | 585/530 |

FOREIGN PATENT DOCUMENTS 1323353 7/1978 United Kingdom .

*Primary Examiner*—Patrick P. Garvin
*Assistant Examiner*—E. D. Irzinski
*Attorney, Agent, or Firm*—Alexander J. McKillop; Dennis P. Santini; Malcolm D. Keen

[57] ABSTRACT

Lubricant compositions comprise blends or mixtures of low viscosity, 3–8 cS e.g. about 5 cS(100° C.), HVI lube basestock with higher viscosity, 15 cS+e.g. 30+ cS(100° C.) HVI PAO lube basestock produced from slack wax by thermal cracking to alpha olefins followed by Lewis acid catalyzed oligomerization of the alpha olefin mixture to lube base stock. Blending these components in appropriate proportions produces lube basestock having viscosities in the range of 8–15 cS (100° C.) from which material suitable for the formulation of 10W-30 automobile engine lube can be produced. The blends are notable for exhibiting high VI values greater than that of either component of the blend.

20 Claims, 1 Drawing Sheet

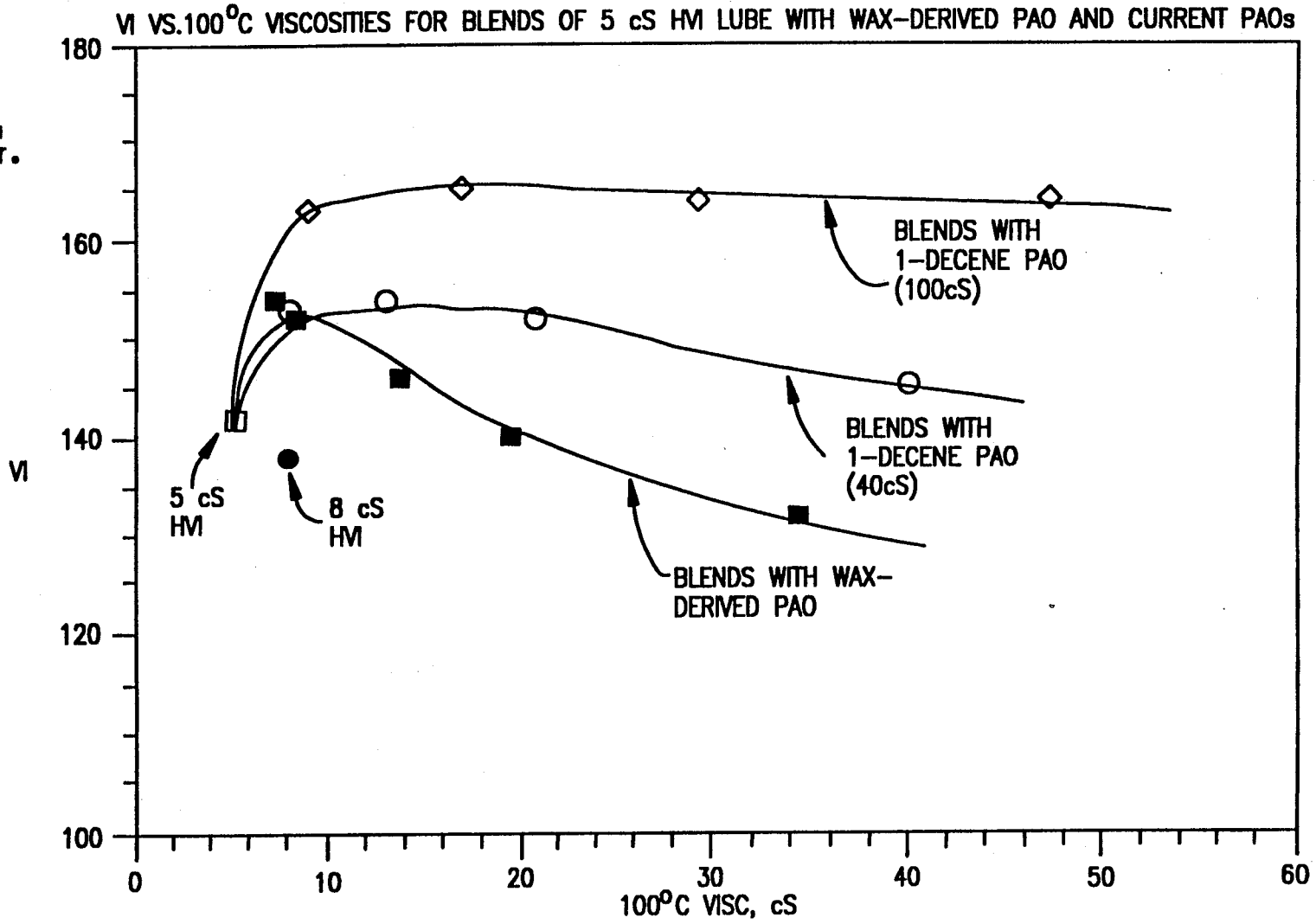
FIG.

HIGH VI LUBRICANT BLENDS FROM SLACK WAX

This is a continuation of copending application Ser. No. 07/818,582, filed on Jan. 9, 1992 and now abandoned.

CROSS-REFERENCE TO RELATED APPLICATIONS

This application is related to co-pending applications Ser. Nos. 07/571,347 and 07/571,345, which relate to lubricants produced by the oligomerization of olefins derived from wax cracking.

FIELD OF THE INVENTION

This invention relates to a process for the production of synthetic lubricant blends prepared from thermally cracked light or medium neutral slack wax (LNSW or MNSW) combined with lubricants from hydroisomerized heavy neutral slack wax (HNSW). In particular, the invention relates to the novel composition of lubricant blends exhibiting high viscosity index (VI) prepared by this process. The lubricant blends so obtained are further distinguished by compositions evincing a VI greater than the VI of the individual components of the blend.

BACKGROUND OF THE INVENTION

Mineral oil based lubricants are conventionally produced by a separative sequence carried out in the petroleum refinery which comprises fractionation of a paraffinic crude under atmospheric pressure followed by fractionation under vacuum to produce distillate fractions (neutral oils) and a residual fraction which, after deasphalting and severe solvent treatment may also be used as a lubricant base stock usually referred as a bright stock. Neutral oils, after solvent extraction to remove low viscosity index (V.I.) components are conventionally subjected to dewaxing, either by solvent or catalytic dewaxing processes, to the desired pour point, after which the dewaxed lube stock may be hydrofinished to improve stability and remove color bodies. This conventional technique relies upon the selection and use of crude stocks, usually of a paraffinic character, which produce the desired lube fractions of the desired qualities in adequate amounts.

The range of permissible crude sources for lubricant production may be extended by the lube hydrocracking process which is capable of utilizing crude stocks of marginal or poor quality, usually with a higher aromatic content than the best paraffinic crudes. The lube hydrocracking process, which is well established in the petroleum refining industry, generally comprises an initial hydrocracking step carried out under high pressure in the presence of a bifunctional catalyst which effects partial saturation and ring opening of the aromatic components which are present in the feed. The hydrocracked product is then subjected to dewaxing in order to reach the target pour point since the products from the initial hydrocracking step which are paraffinic in character include components with a relatively high pour point which need to be removed in the dewaxing step.

Mineral oil derived lubricants have been severely constrained to match the lubrication demands of issuing from modern automotive engine development. Current trends in the design of automotive engines are associated with higher operating temperatures as the efficiency of the engines increases and these higher operating temperatures require successively higher quality lubricants. One of the requirements is for higher viscosity indices (V.I.) in order to reduce the effects of the higher operating temperatures on the viscosity of the engine lubricants. High V.I. values have conventionally been attained by the use of V.I. improvers e.g. polyacrylates, but there is a limit to the degree of improvement which may be effected in this way. In addition, V.I. improvers tend to undergo degradation under the effects of high temperatures and high shear rates encountered in the engine, the more stressing conditions encountered in high efficiency engines result in even faster degradation of oils which employ significant amounts of V.I. improvers. Thus, there is a continuing need for automotive lubricants which are based on fluids of high viscosity index and which are stable to the high temperature, high shear rate conditions encountered in modern engines.

Synthetic lubricants produced by the polymerization of alpha olefins in the presence of certain catalysts have been shown to possess excellent V.I. values, but they are expensive to produce by conventional synthetic procedures and usually require expensive starting materials.

Another approach to the production of high VI oils has been to subject petroleum waxes to severe hydrotreatment (hydrocracking) over an amorphous lube hydrocracking catalyst, followed by dewaxing to target pour point. In processes of this type hydroisomerization of the wax takes place to form high VI iso-paraffins of low pour point. Processes of this kind are described, for instance, in British Patents Nos. 1,429,494, 1,429,291 and 1,493,620 and U.S. Pat. Nos. 3,830,273, 3,776,839, 3,794,580, and 3,682,813. In the process described in GB 1,429,494, a slack wax produced by the dewaxing of a waxy feed is subjected to hydrocracking over a bifunctional hydrocracking catalyst at hydrogen pressures of 2,000 psig of higher, followed by dewaxing of the hydrocracked product to obtain the desired pour point. Dewaxing is stated to be preferably carried out by the solvent process with recycle of the separated wax to the hydrocracking step.

In processes of this kind, the catalyst is typically a bifunctional catalyst containing a metal hydrogenation component on an amorphous acidic support. The metal component is usually a combination of base metals, with one metal selected from the iron group (Group VIII) and one metal from Group VIB of the Periodic Table, for example, nickel in combination with molybdenum or tungsten. Modifiers such as phosphorus or boron may be present, as described in GB 1,350,257, GB 1,342,499, GB 1,440,230, FR 2,123,235, FR 2,124,138 and EP 199,394. Boron may also be used as a modifier as described in GB 1,440,230. The activity of the catalyst may be increased by the use of fluorine, either by incorporation into the catalyst during its preparation in the form of a suitable fluorine compound or by in situ fluoriding during the operation of the process, as disclosed in GB 1,390,359.

A novel lower cost process for the preparation of alpha olefins useful in the production of synthetic lubricants by oligomerization with Lewis acid catalyst such as $AlCl_3$ is described in U.S. patent applications Ser. Nos. 07/571,345 and 07/545,347, filed Aug. 23, 1990, to which reference is made for details of such processes. The process, in brief, involves the thermal cracking of slack wax to produce a mixture of alpha olefins. A portion of the mixed alpha olefins is oligomerized using Lewis acid catalyst. A high viscosity, high VI value lubricant base stock is produced by the process. Typical values for the lubricant product from oligomerization of alpha olefins from the thermal cracking of slack wax are a viscosity of above 30 cS at 100° C. and a VI of about 126.

Specific automotive engine lubricant oil formulations, such as 10W-30 engine oil, have required the use of specific lubricant base stock in order to provide the requisite viscosity, lubricity, high viscosity index and other properties. In turn, the production of the specific lube base stock has been locked into certain raw materials and processes capable of producing lube stock with the requisite properties.

Low viscosity lubes can be produced from neutral slack wax by hydroisomerization. For instance, a lube basestock with a viscosity of 5-6 cS (100° C.) and high VI (HVI) can be produced by hydroisomerization of HNSW in yields of 60 to 65 percent, for example, using a Pt/zeolite beta catalyst, as described in U.S. patent application Ser. No. 07/548,701. However, the production of high VI material from neutral slack wax in high yields is limited to low viscosity products with a viscosity of 6 cS or less, even if the wax is obtained from a heavy neutral oil (HNSW). Higher viscosity products with high VI, such as an 8 cS (100° C.) lube stock preferred for the formulation of 10W-30 engine oil, can only be obtained from a waxy feed of higher average molecular weight, namely, a petrolatum wax (the wax from dewaxing a deasphalted residual oil such as bright stock). Consequently, petrolatum is the preferred raw material for 8 cS HVI lube stock. Petrolatum is, however, a feedstock of limit availability and there is the additional difficulty that the yield of 8 cS HVI product from petrolatum is low, about 36%.

SUMMARY OF THE INVENTION

We have now devised a method for the production of the hgher viscosity grade (over 8 cS, usually 8-15 cS) lubricants from neutral slack waxes, i.e. the waxes obtained from the solvent dewaxing of neutral (distillate) lubestocks. These stocks are more readily available in quantity than the residual stocks from which petrolatum is obtained and accordingly represent a more accessible pathway to the production of the lubricants of higher viscosity and to the blended lube products obtained from these higher viscosity lubestocks.

According to the present invention, the lubricant compositions are obtained by blending low viscosity, i.e., about 5 cS(100° C.), HVI lube basestock with higher viscosity, i.e., 20+cS(100° C.) HVI lube basestocks produced from slack wax by thermal cracking to alpha olefins followed by Lewis acid catalyzed oligomerization of the alpha olefin mixture to lube base stock. Blending these components in appropriate proportions produces lube basestocks having viscosities in the range of 7-15, usually 8-15, cS (100° C.) from which material suitable for the formulation of 10W-30 automobile engine lubes can be produced. The blended products are notable for exhibiting high VI values but most notable is the fact that the blends exhibit VI values greater than that of either lube component of the blend.

The lubricants are obtained in yields superior to those obtained by other methods. The lubricants themselves represent a combination of low viscosity and superior VI not achievable in the prior art from low cost feedstock in high yield.

Preferably, the lower viscosity component of the blend is produced from slack wax by hydroisomerization. Thus, all feedstock for the entire process is derived from abundant and inexpensive grades of slack wax.

One example of the present lubricants is a hydrocarbon lubricant mixture having a viscosity between about 7 cS and 15 cS at 100° C., low pour point and enhanced viscosity index. The mixture comprises a first hydrocarbon lubricant having a viscosity less than 7 cS at 100° C. with a viscosity index less than 150 and a second hydrocarbon lubricant having a viscosity greater than 20 cS at 100° C. The second lubricant or component of the blend comprises the reaction product from Lewis acid catalyzed oligomerization of alpha olefins having an average carbon number of about 10 recovered from the thermal cracking of light neutral slack wax or medium neutral slack wax.

The lubricant blends produced from the hydroisomerization of the neutral slack waxes are produced by hydroisomerizing a heavy neutral slack wax (HNSW) using a hydroisomerization catalyst to produce a low viscosity hydrocarbon lubricant stock having a viscosity between about 5 and 6 cS at 100° C. and a viscosity index between about 140 and 149. In addition, a light or medium neutral slack wax is thermally cracked to produce a mixture of alpha-olefins. The portion of the alpha-olefin mixture having an average carbon number between about 10 and 11 is oligomerized in contact with Lewis acid catalyst to provide hydrocarbon oligomer having a viscosity between about 20 and 500 cS at 100° C. with viscosity index between 120 and 140. The low viscosity hydroisomerized lubricant product is then blended with the cracked slack wax oligomer, to provide blends having viscosity between about 7 cS and 20 cS, viscosity index between about 140 and 160 and pour point below −15° C.

DRAWINGS

The single FIGURE of the accompanying drawings is a graphical representation of one example of the relationship between viscosity index and viscosity expressed in centistokes (cS) at 100° C. for lubricant blends. The graph illustrates the increase in VI of the blend above the VI of either component.

DETAILED DESCRIPTION

The present invention provides a method that is superior to petrolatum hydroisomerization for the production of a lubricant basestock suitable for the formulation of automotive engine lubes such as 10W-30. Petrolatum hydroisomerization may be used to produce lube basestock with a viscosity of about 8 cS (100° C.) and VI of about 140. These lubricant parameters are acceptable for formulating 10W-30; however, petrolatum is expensive and the yield of lube base stock from petrolatum hydroisomerization is only about 36%.

Feed

The feed to the process comprises a petroleum slack wax or recycled slack wax which contains between 10 and 50 weight percent oil, as determined by ASTM test D-3235 and ASTM test D-721, which is obtained from a neutral (distillate) lube stock. In these feeds of mineral oil origin, the waxes are mostly paraffins of high pour point, comprising straight chain and slightly branched chain paraffins such as methylparaffins.

Petroleum waxes, that is, waxes of paraffinic character are derived from the refining of petroleum and other liquids by physical separation from a wax-containing refinery stream, usually by chilling the stream to a temperature at which the wax separates, usually by solvent dewaxing, e.g., MEK/toluene dewaxing or by means of an autorefrigerant process such as propane dewaxing. These waxes have high initial boiling points above about 650° F. (about 345° C.) which render them extremely useful for processing into lubricants which also require an initial boiling point of at least 650° F. (about 345° C.). The presence of lower boiling components is not to be excluded since they will be removed together with products of similar boiling range produced during the separation steps which follow the characteristic processing steps. Since these components will, however, load up the process units they are preferably excluded by suitable choice of feed cut point. The end point of wax feeds derived from the solvent dewaxing of neutral oils, i.e., distillate fractions produced by the vacuum distillation of long or atmospheric resids, will usually be not more than about 1100° F. (about 595° C.) so that they may normally be classified as distillate rather than residual streams; but high boiling wax feeds such as petroleum waxes, i.e., the waxes separated from bright stock dewaxing which may typically have an end point of up to about 1300° F. (about 705° C.), may also be employed.

The wax content of the feed is high, generally at least 50, more usually at least 60 to 80 weight percent, with the balance from occluded oil being divided between aromatics and naphthenics. The non-wax content of aromatics, polynaphthenes and highly branched naphthenes will normally not exceed about 40 weight percent of the wax and preferably will not exceed 25 to 30 weight percent. These waxy, highly paraffinic wax stocks usually have low viscosities because of their relatively low content of aromatics and naphthenes although the high content of waxy paraffins gives them melting points and pour points which render them unacceptable as lubricants without further processing.

Feeds of this type will normally be slack waxes, that is, the waxy product obtained directly from a solvent dewaxing process, e.g. an MEK or propane dewaxing process. The slack wax, which is a solid to semi-solid product, comprising mostly highly waxy paraffins (mostly n- and mono-methyl paraffins) together with occluded oil, may be fed directly to the first step of the present processing sequence as described below without the requirement for any initial preparation, for example, by hydrotreating.

The compositions of some typical waxes are given in Table 1 below.

TABLE 1

| Wax Composition-Arab Light Crude | A | B | C | D |
|---|---|---|---|---|
| Paraffins, wt. pct. | 94.2 | 81.8 | 70.5 | 51.4 |
| Mono-naphthenes, wt. pct. | 2.6 | 11.0 | 6.3 | 16.5 |
| Poly-naphthenes, wt. pct. | 2.2 | 3.2 | 7.9 | 9.9 |
| Aromatics, wt. pct. | 1.0 | 4.0 | 15.3 | 22.2 |

A slack wax is named for the type of base oil from which it is extracted. These base stocks are distinguished by their viscosities, in Saybolt Universal Seconds (SUS), at 100° F. Typical ranges are:

light neutral: 60–200 SUS
medium neutral: 200–450 SUS
heavy neutral: 450–1000 SUS A typical slack wax feed has the composition shown in Table 2 below. This slack wax is obtained from the solvent (MEK) dewaxing of a 300 SUS (65 cST) neutral oil obtained from an Arab Light crude subjected to successive catalytic and solvent dewaxing.

TABLE 2

| Slack Wax Properties | | |
|---|---|---|
| API | 39 | |
| Hydrogen, wt. pct. | 15.14 | |
| Sulfur, wt. pct. | 0.18 | |
| Nitrogen, ppmw | 11 | |
| Melting point, °C. (°F.) | 57 | (135) |
| KV at 100° C., cST | 5.168 | |
| PNA, wt. pct: | | |
| Paraffins | 70.3 | |
| Naphthenes | 13.6 | |
| Aromatics | 16.3 | |
| Simulated Distillation: | | |
| % | °C. | (°F.) |
| 5 | 375 | (710) |
| 10 | 413 | (775) |
| 30 | 440 | (825) |
| 50 | 460 | (860) |
| 70 | 482 | (900) |
| 90 | 500 | (932) |
| 95 | 507 | (945) |

Another slack wax suitable for use in the present process has the properties set out in Table 3 below. This wax is prepared by the solvent dewaxing of a 450 SUS (100 cS) neutral raffinate:

TABLE 3

| Slack Wax Properties | | |
|---|---|---|
| Boiling range, °F. (°C.) | 708–1053 | (375–567) |
| API | 35.2 | |
| Nitrogen, basic, ppmw | 23 | |
| Nitrogen, total, ppmw | 28 | |
| Sulfur, wt. pct. | 0.115 | |
| Hydrogen, wt. pct. | 14.04 | |
| Pour point, °F. (°C.) | 120 | (50) |
| KV (100° C.) | 7.025 | |
| KV (300° F., 150° C.) | 3.227 | |
| Oil (D 3235) | 35 | |
| Molecular wt. | 539 | |
| P/N/A: | | |
| Paraffins | — | |
| Naphthenes | — | |
| Aromatics | 10 | |

Other useful slack waxes in the present invention are a typical medium neutral slack wax with properties shown in Table 4 and typical light neutral slack waxes with properties shown in Table 5.

TABLE 4

| Medium Neutral Slack Wax | |
|---|---|
| Mol. Wt. (1524) | 453 |
| API gravity: | 37.7 |
| Oil content (D3235) | 15% wt % |
| Mass Spec. Analysis (M1085) | wt % |
| paraffins | 78.5 |
| mononaphthenes | 8.3 |
| polynaphthenes | 4.8 |
| aromatics | 8.4 |

TABLE 5

| Light Neutral Slack Wax (LNSW) | |
|---|---|
| Mol. Wt. (M1524) | 338 |

TABLE 5-continued

| Light Neutral Slack Wax (LNSW) | |
|---|---|
| Oil content (D3235) | 16.3% wt % |
| Mass Spec. Analysis (M1085) | wt % |
| paraffins | 84.9 |
| mononaphthenes | 4.4 |
| polynaphthenes | 6.9 |
| aromatics | 3.8 |

Of the two principal components of the blends of the instant invention one is derived from slack wax by thermal cracking to produce alpha olefins followed by oligomerization of a portion of the alpha olefins to polyalpha-olefin (PAO) lube basestock. The preparation of the PAO used in the present invention is carried out in the manner described below.

Slack Wax Cracking and Oligomerization

Slack wax feedstock is thermally cracked under conditions suitable for the production of a crackate, or product of the cracking process, containing predominantly alpha olefins. Thermal cracking is well known in the refinery art and the present thermal cracking process can be carried out in a variety of process configurations, continuous or batch-wise. Typically, the hot wax is fed to the top of a vertical reactor containing quartz (e.g. "Vycor" TM) chips or other inert material. The wax is typically cracked at a temperature between about 950° F. and 1200° F. (510° C.-648° C.) and a pressure between about 50 kPa and 980 kPa at a liquid hourly space velocity (LHSV) between about 0.3 and 20. A preferred cracking temperature is about 590° C. and a preferred pressure is about 103 kPa at a LHSV of about 2. In practice, the wax feed is typically diluted with 1 to 70 percent by volume of an inert gas such as nitrogen or steam. Following thermal cracking the cracking product is fractionally distilled and fractions having carbon number between five and eighteen collected and combined as feedstock for subsequent polymerization to synthetic lubricant.

The oligomerization feedstock mixture typically comprises a $C_5$-$C_{18}$ fraction or $C_6$-$C_{16}$ fraction of olefinic hydrocarbons from fractionation of the thermal cracking product. A preferred fraction is $C_6$-$C_{17}$ olefinic hydrocarbons. It has been found that using a narrower cut of olefinic hydrocarbons can improve the lube product properties, but at the cost of reducing lube yields. Decreasing the amount of $C_5$-$C_6$ hydrocarbons in the oligomerization feedstock generally boosts the VI of the lube product, and decreasing the amount $C_{16}$-$C_{18}$ generally improves lube pour point. However, in the present invention it has been found that using a feedstock comprising $C_5$-$C_{18}$ or $C_6$-$C_{16}$ hydrocarbons provides lube products with surprisingly high VI. Prior to oligomerization the feedstock is purified to remove moisture and oxygenated organic compounds such as alcohols, ethers, peroxides and esters which would interfere with the oligomerizations process.

Oligomerization is suitably carried out using a Lewis acid catalyst such as aluminum chloride, boron trifluoride, $SnCl_4$ and the like. A promoted aluminum chloride is the preferred catalyst. Effective promoters for use with Lewis acids include protonic promoters such as alcohols, carboxylic acids or water. With aluminum chloride as used in the present invention water is an effective promoter. Generally, the mole ratio of $AlCl_3$ to water added as promoter is between 10 and 0.1. A mole ratio of about 1 to 2 is preferred.

The oligomerization may be carried batch-wise or continuous; neat or in solution. Useful solvents include non-reactive hydrocarbons, particularly paraffinic materials such as cyclohexane, octane or higher hydrocarbons. The process is typically carried out under oligomerization conditions comprising temperature between about 0° C. and 250° C. for a time sufficient to produce the synthetic lubricant basestock in the requisite viscosity. A wide range of pressures can be used, but typically between 1000 kPa and 35 kPa. Preferably, the oligomerization is carried out at about atmospheric pressure (102 kPa). Less than 10 weight percent of catalyst is employed, based on olefin in the feedstock, but higher amounts may be used. Preferably, about five weight percent of $AlCl_3$ catalyst is used, based on olefin.

Following the oligomerization step the catalyst is removed by washing with dilute acid, base and water and the organic product is separated by distillation to remove components boiling below 400° C. The product recovered has a kinematic viscosity measured at 100° C. between above 4 cS and 200 cS, a viscosity index above 120 and a pour point below −15° C.

According to the practice typical in the petroleum lubricant arts the product is hydrogenated to saturate residual olefinic bonds. Hydrogenation can be carried out by any of numerous methods well known to those skilled in the art. A preferred method is to hydrogenate the product at elevated and pressure in contact with Pd or Pt on charcoal or Ni on Kieselguhr Catalyst.

Table 6 presents the conditions and product yields from thermally cracking light neutral slack wax (LNSW) at 590° C. Table 7 presents the yields and properties of PAO produced from alpha-olefins from the cracking of LNSW, with the oligomerization carried out with 5 wt % $AlCl_3$ (water-promoted), molar ratio of $H_2O/AlCl_3=0.6/1$, 50°-60° C., 16 hours reaction time.

TABLE 6

| | Thermal Cracking of LNSW | | | |
|---|---|---|---|---|
| Run<br>Feed | A<br>LNSW | B<br>LNSW | C<br>Recycled | D<br>2 × recycled |
| Feed rate, ml/hr | 50 | 80 | 80 | 80 |
| $C_{19}$+ conversion, wt % | 35 | 28 | 27 | 27 |
| Wt % yields: | | | | |
| $C_1$-$C_3$ | 9.1 | 6.1 | 5.7 | Not Analyzed |
| $C_4$ | 1.9 | 1.2 | 1.3 | |
| $C_5$ | 2.2 | 1.4 | 1.4 | |
| $C_6$ | 3.1 | 2.4 | 2.7 | |
| $C_7$-$C_{18}$ | 18.3 | 16.9 | 16 | |
| Total $C_5$-$C_{18}$ | 23.5 | 20.7 | 20.1 | |
| Wt % Selectivites | | | | |
| $C_1$-$C_3$ | 26.1 | 21.5 | 21.0 | |
| $C_4$ | 5.5 | 4.4 | 4.8 | |
| $C_5$ | 6.3 | 5.0 | 5.2 | |
| $C_6$ | 8.9 | 8.7 | 10.0 | |
| $C_7$-$C_{18}$ | 52.3 | 60.2 | 59.0 | |
| Total $C_5$-$C_{18}$ | 67.5 | 73.5 | 74.2 | |

TABLE 7

| PAO Yields and Properties from Alpha-Olefins from LNSW | | | | | |
|---|---|---|---|---|---|
| Run | E | F | G | H | I |
| Wax Source (Run) | B | B | C | D | D |
| Avg. Carbon No. | 10.2 | 10.7 | 9.9 | 10.4 | 10.8 |
| Carbon No. Range | $C_6$-$C_{17}$ | $C_6$-$C_{18}$ | $C_5$-$C_{16}$ | $C_7$-$C_{16}$ | $C_5$-$C_{18}$ |
| Isolated Lube Yield % | 92 | 91 | 91 | 90 | 87 |
| Lube Properties after | | | | | |

TABLE 7-continued

| PAO Yields and Properties from Alpha-Olefins from LNSW | | | | | |
|---|---|---|---|---|---|
| Run | E | F | G | H | I |
| Hydrogenation: | | | | | |
| V @ 100° C., cS | 34.4 | 35.4 | 50.7 | 32.5 | 36.1 |
| V @ 40° C., cS | 379.1 | 393.9 | 694.4 | 361.9 | 422.5 |
| VI | 132 | 132 | 127 | 128 | 128 |
| Pour Point, °C. | −36 | −29 | −33 | −45 | −41 |
| Thermal Stability in % Viscosity Change | | | | | |
| @ 280° C. | 5.7 | 15 | 15 | — | — |
| @ 300° C. | 15.8 | 19 | 21 | — | — |

Low Viscosity Component

The second component of the lubricant blend is a low viscosity hydrocarbon lubricant fluid, preferably having a viscosity between 4–6 cS (100° C.), but more preferably a viscosity of about 5 cS (100° C.) and a VI at least above 100. This component can be prepared by suitable fractionation of mineral oil having a high wax content.

The second lube component prefeably has a VI value well above 125 and preferably above 140 at a low viscosity of about 5 cS (100° C.) Hydrocarbon lube materials with a viscosity of about 5 cS and VI of about 148 can be produced in yields of 60–65% by the hydroisomerization of heavy neutral slack wax, as described in Ser. No. 07/548,701, filed 5 Jul. 1990, to which reference is made for a description of the wax hydroisomerization process. Other was hydroisomerization processes utilize an amorphous lube hydrocracking catalyst, as described above. Processes of this kind are described, for instance, in British Patents Nos. 1,429,494, 1,429,291 and 1,493,620 and U.S. Pat. Nos. 3,830,273, 3,776,839, 3,794,580, and 3,682,813 and French patent FR 2,576,031, to which reference is made for a description of such processes. The hydroisomerization of slack wax is also described in U.S. Pat. No. 4,975,117 (Garwood), U.S. Pat. No. 4,986,894 (Keville) and U.S. Pat. No. 4,428,819 (Shu).

The following Examples are intended to illustrate the process of the present invention for the preparation of hydrocarbon lubricant blends.

EXAMPLE 1

Preparation of PAO by Slack Wax Cracking and Polymerization

A light neutral slack wax having the properties listed in Table 5 was fed at 50–80 ml/hr along with 30 SCCM of nitrogen through a reactor tube filled with 45 cc of quartz ("Vycor" TM) chip and heated to about 590° C. with vapor residence times of about 5–10 seconds.

Product yields from two cracking runs at different flow rates are summarized in Columns A and B of Table 6. The products from these runs were distilled to remove $C_{18}-$ products. The distilled bottoms (approximately $C_{19}+$) from run B were recracked with yields shown in column C of Table 6. Column D is recracking of the bottoms from the products of Run C combined with the bottoms of Run A.

The liquids collected from the slack wax cracking runs were fractionated at 1 Atm and under vacuum of 0.05–0.01 torr to obtain fractions of average carbon length of 10–11. These fractions were polymerized over $AlCl_3$ catalyst promoted by water. The polymer product was isolated by washing with dilute HCl and NaOH aqueous solution to remove catalyst. The organic product was then distilled to remove light components with boiling points below 150° C. @0.01 mm Hg.

The lube product was hydrogenated at 240° C. and 400 psi hydrogen pressure with 2 wt % Ni on Kielselguhr catalyst for four hours. The synthesis and properties of the lube products are summarized in Table 7. The lubes produced had viscosities greater than 20 cS at 100° C.

EXAMPLE 2

Blends of Wax-derived PAO with 5 cS HVI Lube

A 5 cS (100° C.) lube basestock produced by the hydroisomerization of slack wax over an amorphous catalyst ($NiW/Al_2O_3$) was blended with different amounts of PAO produced according to Example 1. The properties of the blends are summarized in Table 8.

TABLE 8

| 5cS HVI Blended with Slack Wax Derived PAO | | | | | | |
|---|---|---|---|---|---|---|
| | | | Blend Properties | | | |
| Blend | PAO (Table 7) | Wt % PAO in 5cS HVI | V @ 100° C. cS | V @ 40° C. cS | VI | Pour Point °C. |
| J | | 0 | 5.13 | 24.13 | 148 | −16 |
| K | E | 24 | 7.12 | 40.75 | 154 | −16 |
| L | E | 57 | 13.62 | 95.07 | 146 | |
| M | E | 73.4 | 19.25 | 157.41 | 140 | |
| N | E | 100 | 34.46 | 379.11 | 132 | −32 |
| O | I | 24 | 7.78 | 41.82 | 159 | |
| P | I | 100 | 36.18 | 429.17 | 126 | −41 |
| Compararitive Product: | | | | | | |
| 8cS (100° C.) HVI from petrolatum | | | 7.81 | 46.30 | 138 | −18 |

When 24 weight percent of the PAO was added to the 5 cS HVI, blends of 7.12 and 7.78 cS with VI of 154 and 159 (K & O) were produced. Compared to the 7.8 cS HVI produced directly from hydroisomerization of petrolatum, blends K & O have much higher VI, 154 and 159 versus 145. Indeed, the VI of the blends is surprisingly higher than the VI of either PAO or the 5 cS HVI, indicating a synergistic effect of blending the two. The product blends have pour point very similar to that of the product produced from petrolatum.

When more wax derived PAO (57% or 73%) was added to the 5 cS HVI, blends of 13.6 or 19.3 cS were obtained with VI values of 146 and 140 (L & M). These blends have very high viscosity, not available from any conventional mineral lube processing technology.

These blending results demonstrate that high quality lube basestock of wide viscosity range, high VI and good pour point can be produced from inexpensive and abundant slack wax in good yield exceeding 55%. The yield of $C_5$–$C_{18}$ from thermal cracking of slack wax at low conversion with recycle to extinction is about 60–65 wt %. Lube recovery from polymerization is about 92% providing a yield of about 55–60% of 40 cS lube from slack wax. Considering that the yield of 5 cS lube from heavy neutral slack wax is about 60–65 wt %, as reported herein before, blends yields in excess of 55 wt % are achievable.

These advantages can be translated into the formulation of wider cross-graded, high performance engine oils.

The FIGURE which relates the VI and the vscosity of the blends, illustrates the surprising enhancement of VI when various proportions of the components are mixed, as documented in Table 8. The FIGURE also shows VI versus viscosity for blends of 5 cS HVI lube with conventional commercially available PAO prepared by oligomerization of 1-decene to provide a 100 cS material and a 40 cS material at 100 ° C.

What is claimed is:

1. A hydrocarbon lubricant mixture having viscosity between about 7 cS and 15 cS at 100° C., low pour point and enhanced viscosity index comprising a first hydrocarbon lubricant having a viscosity less than 7 cS at 100° C. and a second hydrocarbon lubricant having a viscosity greater than 20 cS at 100° C., produced by the Lewis acid catalyzed oligomerization of alpha olefins having an average carbon number of about 10 recovered from the thermal cracking of slack wax from a distillate petroleum fraction to form an olefin oligomer which is hydrogenated to form the second hydrocarbon lubricant.

2. The hydrocarbon lubricant mixture of claim 1 in which the viscosity index of the mixture is greater than the viscosity index of either the first or second lubricant.

3. The hydrocarbon lubricant mixture of claim 1 in which the first lubricant is produced by the hydroisomerization of heavy neutral slack wax.

4. The mixture of claim 1 in which the first lubricant has a viscosity between 4 cS and 7 cS at 100° C. with a viscosity index between 130 and 150.

5. The mixture of claim 4 in which the first lubricant has a viscosity of about 5 cS at 100° C. with a viscosity index between 140 and 150.

6. The mixture of claim 1 in which the second lubricant has a viscosity more than 20 cS at 100° C. and a viscosity index between 120 and 160.

7. The mixture of claim 6 in which the second lubricant has a viscosity between 30 cS and 100 cS at 100° C. and a viscosity index between 120 and 160.

8. The mixture of claim 1 containing between 20 and 60 weight percent of the second lubricant and having a viscosity between about 7 cS and 15 cS at 100° C., a viscosity index between 140 and 170 and pour point below −15° C.

9. The mixture of claim 1 having a viscosity of between 7 cS and 8 cS at 100° C. and viscosity index between about 150 and 160, the mixture comprising between 20 and 30 weight percent of the first lubricant having a viscosity of about 5 cS at 100° C. and a viscosity index less than 150 plus between 80 and 70 weight percent of the second lubricant having a viscosity between about 30 cS and 100 cS at 100° C. and a viscosity index less than 160.

10. The mixture of claim 9 having a pour point less than −15° C.

11. A process for the production of hydrocarbon lubricant blends having low viscosity and an enhanced viscosity index comprising:

a) hydroisomerizing slack wax to produce a hydrocarbon lubricant product having a viscosity between about 5 and 6 cS at 100° C. and a viscosity index between about 140 and 149;

b) thermally cracking a neutral slack wax to produce a mixture of alpha-olefins and recovering the portion of the alpha-olefin mixture having an average carbon number between about 10 and 11;

c) oligomerizing the recovered alpha-olefins in contact with Lewis acid catalyst to provide hydrocarbon oligomer;

d) hydrogenating the oligomer to form a hydrocarbon lubricant component having a viscosity between about 30 and 40 cS at 100° C. with viscosity index between 120 and 140;

e) mixing the step (a) lubricant product and the step (e) hydrocarbon oligomer to provide a lubricant blend having a viscosity between about 7 cS and 20 cS, viscosity index between about 140 and 160 and pour point below −15° C.

12. The process of claim 11 in which the step (a) product has a viscosity of about 5 cS at 100° C., viscosity index of about 148 and comprises about 75 weight percent of the blend; step (c) oligomer has a viscosity of about 36 cS at 100° C., viscosity index of about 126 and comprises about 25 weight percent of the blend; and the blend has a viscosity of about 8 cS at 100° C. and a viscosity index of about 159.

13. The process of claim 11 in which the step (a) product has a viscosity of about 5 cS at 100° C., viscosity index of about 148 and comprises about 43 weight percent of the blend; step (c) oligomer has a viscosity of about 36 cS at 100° C., viscosity index of about 126 and comprises about 57 weight percent of the blend; and the blend has a viscosity of about 14 cS at 100° C. and a viscosity index of about 146.

14. The process of claim 11 in which the step (a) product has a viscosity of about 5 cS at 100° C., viscosity index of about 148 and comprises about 26 weight percent of the blend; step (c) oligomer has a viscosity of about 36 cS at 100° C., viscosity index of about 126 and comprises about 74 weight percent of the blend; and the blend has a viscosity of about 19 cS at 100° C. and a viscosity index of about 140.

15. The process of claim 11 in which the Lewis acid comprises $AlCl_3$.

16. The process of claim 11 in which the blends have pour point below −15° C.

17. A process for the production of hydrocarbon lubricant blends having low viscosity and an enhanced viscosity index comprising: mixing a first hydrocarbon lubricant having a viscosity less than 7 cS at 100° C. with a viscosity index less than 150 and a second hydrocarbon lubricant having a viscosity greater than 30 cS at 100° C., the second lubricant comprising the hydrogenated reaction product from Lewis acid catalyzed oligomerization of alpha olefins having an average carbon number of about 10 recovered from the thermal cracking of a neutral slack wax.

18. The process of claim 17 in which the first lubricant comprises the reaction product from the hydroisomerization of slack wax.

19. The process of claim 17 in which the first lubricant has a viscosity of about 5 cS at 100° C., viscosity index of about 148 and comprises about 75 weight percent of the blend; the second lubricant has a viscosity of about 36 cS at 100° C., viscosity index of about 126 and comprises about 25 weight percent of the blend; and the blend has a viscosity of about 8 cS at 100° C. and a viscosity index of about 159.

20. The process of claim 17 in which the first lubricant has a viscosity of about 5 cS at 100° C., viscosity index of about 148 and comprises about 43 weight percent of the blend; the second lubricant has a viscosity of about 36 cS at 100° C., viscosity index of about 126 and comprises about 57 weight percent of the blend; and the blend has a viscosity of about 14 cS at 100° C. and a viscosity index of about 146.

* * * * *